US007698831B2

(12) United States Patent
Higgs et al.

(10) Patent No.: US 7,698,831 B2
(45) Date of Patent: Apr. 20, 2010

(54) TILE SPACER AND HOLDER THEREFOR

(75) Inventors: David John Higgs, Vancouver (CA); Davor Baros, Vancouver (CA)

(73) Assignee: Zashiki-Warashi Manufacturing Inc., Vancouver (CA)

( * ) Notice: Subject to any disclaimer, the term of this patent is extended or adjusted under 35 U.S.C. 154(b) by 107 days.

(21) Appl. No.: 12/051,711

(22) Filed: Mar. 19, 2008

(65) Prior Publication Data

US 2009/0235548 A1 Sep. 24, 2009

(51) Int. Cl.
*E04F 21/18* (2006.01)

(52) U.S. Cl. ..... 33/526; 33/DIG. 20; 15/105.5; 206/303

(58) Field of Classification Search ..... 33/526, 33/527, DIG. 20; 15/105, 105.5, 245; 206/303; 30/167.2; 7/164, 167, 170; 81/490
See application file for complete search history.

(56) References Cited

U.S. PATENT DOCUMENTS

| | | | | |
|---|---|---|---|---|
| 1,590,172 | A * | 6/1926 | Thorberg | 206/303 |
| 2,031,684 | A | 2/1936 | Berger | |
| 2,836,055 | A | 5/1958 | Shuman | |
| 2,940,264 | A | 6/1960 | Harper et al. | |
| 3,010,213 | A | 11/1961 | Rodtz, Sr. | |
| 4,503,654 | A | 3/1985 | Cosentino | |
| 4,793,068 | A | 12/1988 | Golkar | |
| 4,953,341 | A | 9/1990 | Joos | |
| 5,010,654 | A | 4/1991 | Funes, Jr. | |
| 5,191,718 | A | 3/1993 | Fox | |
| D337,247 | S | 7/1993 | Dart | |
| 5,288,534 | A | 2/1994 | Tavshanjian | |
| 5,359,783 | A | 11/1994 | Smith | |
| 5,623,799 | A | 4/1997 | Kowalski et al. | |
| 5,743,391 | A * | 4/1998 | Hsiao | 206/303 |
| 6,354,058 | B1 | 3/2002 | Lewis | |
| 6,394,518 | B1 | 5/2002 | Kelley | |
| 6,612,045 | B2 | 9/2003 | Kruskamp | |
| 6,647,685 | B2 | 11/2003 | Annarella et al. | |
| D492,210 | S | 6/2004 | Shilo et al. | |

(Continued)

FOREIGN PATENT DOCUMENTS

CA 2599991 A1 * 3/2009

(Continued)

OTHER PUBLICATIONS

The Official Daily Publication of the National Hardware Show Wednesday Daily, made public on May 7, 2008 . . . , p. 22.

(Continued)

*Primary Examiner*—R. A. Smith
(74) *Attorney, Agent, or Firm*—Cameron IP

(57) ABSTRACT

A tile spacer for a plurality of tiles arranged on the surface with spaces in between. The tile spacer has a first set of elongate members, each having a proximal end and a distal end. The proximal ends are connected together and the distal ends are spaced-apart for setting the spaces between the tiles. The spacer has a body having a portion which is spaced-apart above the tiles when the distal ends of the members are fitted within the spaces between the tiles, thereby facilitating removal of the spacer when tile spacing is completed.

30 Claims, 11 Drawing Sheets

U.S. PATENT DOCUMENTS

| | | | | |
|---|---|---|---|---|
| 6,769,191 | B1 | 8/2004 | Zusman | |
| 6,823,640 | B1 | 11/2004 | Pytlewski | |
| 6,874,242 | B2 | 4/2005 | Shilo et al. | |
| 7,093,714 | B2 * | 8/2006 | Huang | 206/303 |
| 7,475,488 | B2 | 1/2009 | Symington | |
| 7,536,802 | B1 * | 5/2009 | Tavy et al. | 33/527 |
| 2002/0121027 | A1 | 9/2002 | Kruskamp | |
| 2003/0226271 | A1 | 12/2003 | Cordell | |
| 2004/0060184 | A1 | 4/2004 | Shilo et al. | |
| 2004/0250435 | A1 | 12/2004 | Fiore | |
| 2005/0214502 | A1 | 9/2005 | Westthorp | |
| 2005/0257468 | A1 | 11/2005 | Serros et al. | |
| 2007/0011898 | A1 | 1/2007 | Frank et al. | |
| 2007/0022693 | A1 | 2/2007 | Ran | |
| 2007/0227025 | A1 | 10/2007 | Venture | |

FOREIGN PATENT DOCUMENTS

| | | | |
|---|---|---|---|
| EP | 258108 | A1 * | 3/1988 |
| EP | 1577460 | A2 | 9/2005 |
| GB | 2331322 | | 5/1999 |
| WO | WO 03/033837 | A1 | 4/2003 |
| WO | WO2004/001159 | A1 | 12/2003 |
| WO | WO 2006/072772 | A2 | 7/2006 |
| WO | WO 2006/075180 | | 7/2006 |

OTHER PUBLICATIONS http://www.tilejax.com/product/index.html.

* cited by examiner

TILE SPACER AND HOLDER THEREFOR

BACKGROUND OF THE INVENTION

This invention relates to tile spacers which are used for locating tiles so they are evenly spaced-apart before the tiles are secured to a surface so that the grout lines are even and regular.

International Patent Application Number PCT/GB2006/000132 to Skillings illustrates a tile spacer that enables the setting of a variety of tile patterns. However, Skillings suffers a number of disadvantages including being unable to provide spacing for all corner configurations.

Also, the tile spacers of prior art such as that of Skillings may touch and obstruct visibility of the front face of the tile. As a result, the tile spacer of Skillings is shaped such that adhesive build up is difficult if not impossible at times to identify.

Excessive adhesive tends to hide in tile corner areas. This causes further difficulty for the installer in identifying excess adhesive or adhesive that transfers or squeezes up on to the surface of the tile. This is an even more significant problem if the tile has a porous nature such as clay, terracotta, natural stone, and made or satin finishes. Moreover, such adhesive is difficult if not impossible to clean up under the area of this type tile spacer.

Accordingly, there is a need for a tile spacer that overcomes the above disadvantages.

Tiles are manufactured in differing shapes and sizes and thicknesses. The arrangement of such tiles is often a matter of individual taste, artistic interpretation and ability. It is therefore a further general aim of the invention to provide a removable spacer that reduces the time consuming laborious nature of the task of tile installation with a tile spacer that can be used with ease by a skilled worker or an amateur equally.

A further drawback of the prior art concerns the ability to provide the user with a ready supply of adhesives, tools, tiles spacers, and cleaning equipment. Traditional tiles spacers are provided in plastic bags. Often piles of materials are staged at certain locations for ready access. These bags will move with the user either in their pocket, mouth or hands. However, when sitting, kneeling or crouching during typical floor tiling operations, this is cumbersome, tying up the hands. The interiors of the pockets are also extremely frustrating to access. This is particularly true if the user has gloves with the gloved hand picking up a small piece of plastic from a flat surface or from a deep pocket. Also, staging piles of tile spacers or bags in a general location results in tile spacers quickly becoming out of reach. This is especially true in vertical wall tiling operations.

The most common and readily available tile spacers in general hardware stores and specialty tile supply outlets are illustrated by numerals 10 in FIG. 1. The tile spacers 10 have either a cross-shape configuration 12 or a T-shaped configuration 14 configuration. The tile spacers 10 suffer a disadvantage in that they are often left within the grout. This results in the tile spacers 10 not being reused, which is thus more wasteful and expensive for a user. In the alternative, the tile spacers 10 are removed, but with great difficulty.

Moreover, the tile spacers 10 of the prior art are restricted to tiles requiring square or brick patterns when laid flat at tile intersection points during the installation process. Accordingly, the tile spacers 10 have significant limitations in terms of the variety of tile patterns with which they can function.

In order to be used in different configurations, the spacers in FIG. 1 can be inserted with end 13 in first. This however significantly increases the number of spacers required per installation as two spacers are required per edge.

BRIEF SUMMARY OF THE INVENTION

Accordingly, the subject matter of the present invention provides a solution that overcomes the above disadvantages of the prior art. More particularly, the present invention provides a solution in the form of an improved removable tile spacer that enables the setting of a greater variety of tile patterns in a greater variety of locations, that is reusable, that promotes visual inspection of and access to underlying adhesive, and that is easy to handle and remove thereafter. The present invention also provides a solution in the form of a multi-purpose tiling tool for the tiling.

There is provided, according to one aspect of the invention, a tile spacer for a plurality of tiles arranged on the surface with spaces in between. The tile spacer has a first set of elongate members, each having a proximal end and a distal end. The proximal ends are connected together and the distal ends are spaced-apart for setting the spaces between the tiles. The spacer has a body having a portion which is spaced-apart above the tiles when the distal ends of the members are fitted within the spaces between the tiles, thereby facilitating removal of the spacer when tiling is completed.

There is provided, according to another aspect of the invention, a combination of a tile spacer and a plurality of tiles arranged on the surface with spaces in between. The tile spacer has a first set of elongate members, each having a proximal end and a distal end. The proximal ends are connected together and the distal ends are spaced-apart for setting the spaces between the tiles. The spacer has a body having a portion which is spaced-apart above the tiles when the distal ends of the members are fitted within the spaces between the tiles, thereby facilitating removal of the spacer when tile spacing is completed.

BRIEF DESCRIPTION OF THE DRAWINGS

Referring to the drawings.

DESCRIPTION OF THE PREFERRED EMBODIMENTS

Figure 1:
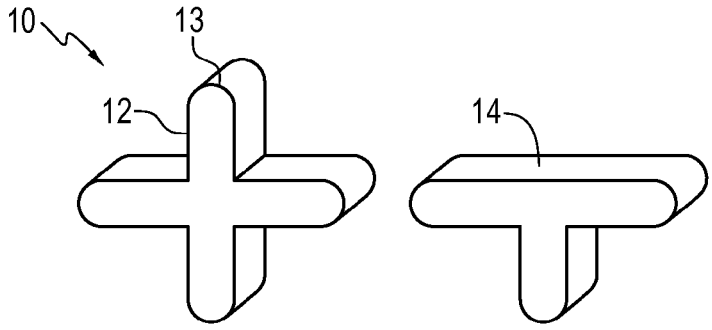
FIG. 1 (Prior Art)
FIG. 1 is a top perspective view of tile spacers according to the prior art.
Figure 2:
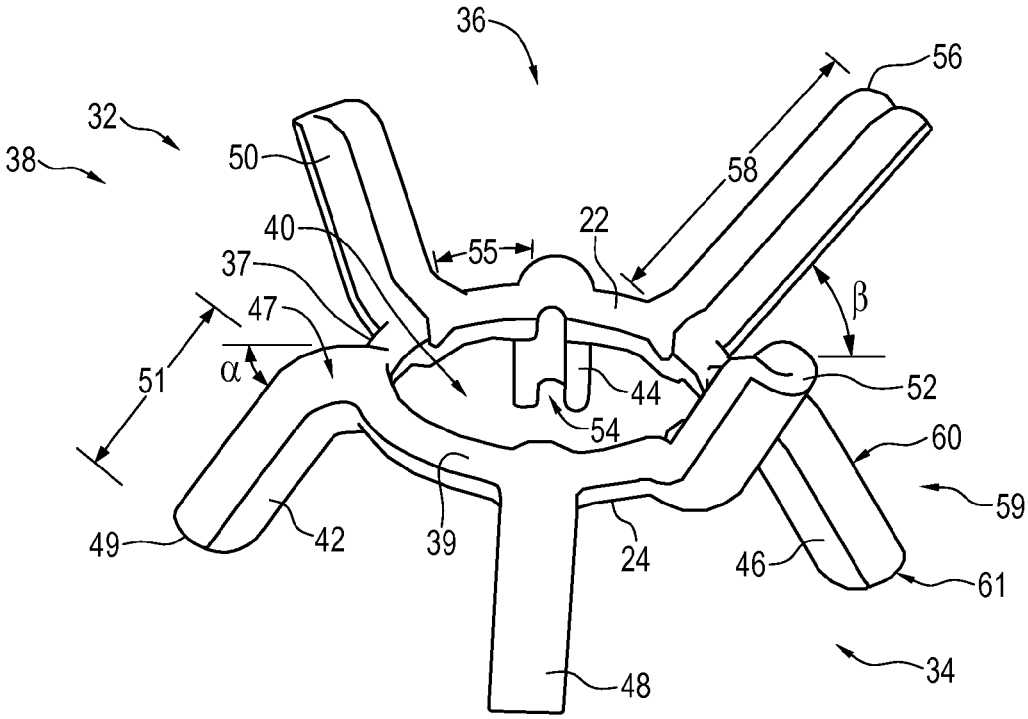
FIG. 2 is an isometric view of the removable tile spacer according to one embodiment of the present invention.

Referring to FIG. 2, a removable tile spacer 32 is illustrated according to one embodiment of the invention. The tile spacer 32 has a first side 34 and a second side 36 opposite the first side 34. The tile spacer 32 includes a connecting member or body 37 which in this example is in the form of an annulus with an aperture 40. The body 37 has a first face 22 and a second face 24 opposite the first face.

The tile spacer 32 includes a plurality of elongate members extending from the body 37 including a first elongate member 42, a second elongate member 44, a third elongate member 46, and a fourth elongate member 48 which all are radially spaced-apart and which extend toward the first side 34 of the tile spacer 32. Each of the elongate members is flexible in this example and has a proximal end connected to the body 37, for example proximal end 47 of member 42, and a distal end, for example distal end 49 of member 42. The distal ends of the members 42, 44, 46 and 48 define a first plane which in this example is parallel with the body 37.

The plurality of elongate members also include a fifth elongate member 50, a sixth elongate member 52, and a seventh elongate number 56 which extend toward the second side 36 of the spacer. In other words, they are on the opposite side of the tile spacer compared to the members 42, 44, 46 and 48. The sixth member 52 in this example is opposite the fifth member 50 and is angularly space-apart 180 degrees therefrom about the body 37. In this example, the fifth member 50 is between the first member 42 and the second member 44, and the sixth member 52 is between the third member 46 and the fourth member 48.

The first member 42, the second member 44, the third member 46, the fourth member 48, the fifth member 50 and the sixth member 52 are labelled as such only for the sake of ease of description, are all similar in shape and size in this example, and are spaced-apart angularly about the body 37. Accordingly, only the first member 42 will be described in detail.

Figure 3:
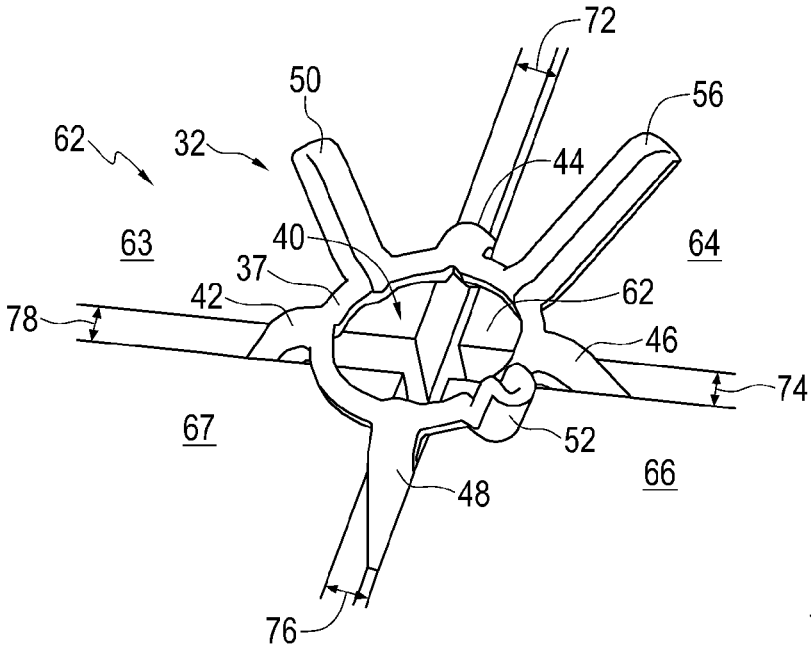
FIG. 3 is an isometric view of the tile spacer of FIG. 2 interposed between tiles arranged in a four tile cross-shape pattern.
Figure 3A:
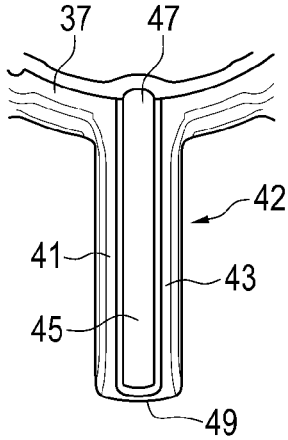
FIG. 3*a* is an inverted, partially broken away view of an elongate member according to the embodiment of FIG. 2.
Figure 4:
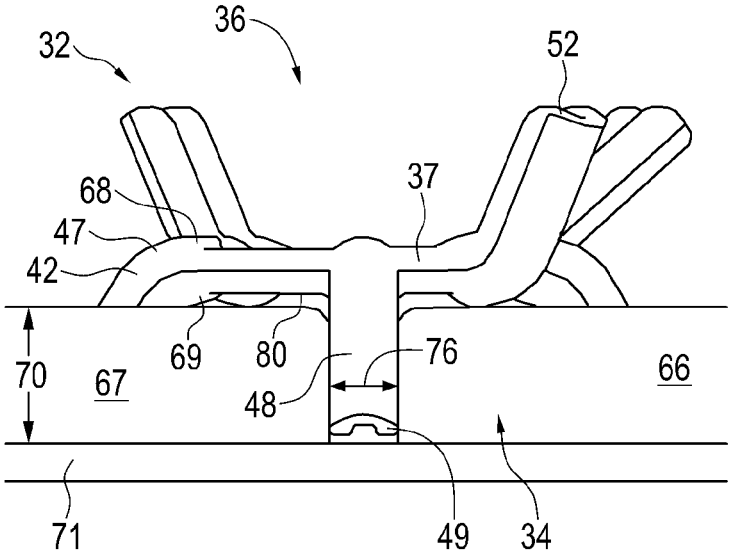
FIG. 4 is a front elevation view of FIG. 3.

Referring to FIG. 3*a*, the first member 42 is channel-shaped in this example, though this is not essential. The member has a pair of parallel flanges 41 and 43 spaced-apart by a central groove 45 that is concave in this example. The member 42 projects above the rest of body 37 towards aside 36 of the spacer at 68 as seen in FIG. 4. Similarly it projects below the rest of body 37 towards side 34 as seen at 69 in FIG. 4.

Referring back to FIG. 2, the first member 42 has a length 51 which may be between 6 mm and 100 mm. The first member 42 radially extends away from the body 37 while also extending towards the first side 34 at an angle $\alpha$. The angle $\alpha$ may be in the range of 45 to 75 degrees, and in this example, is approximately 60 degrees. Put another way, member 42 in this example extends outwards from the connecting member or body 37 at an angle of 120 degrees relative to the connecting member. As stated, the members 44, 46 and 48 are similar. Also the members 50 and 52 in this embodiment are similar although extending towards the opposite side 36 of the spacer.

The seventh member 56 also extends toward the second side 36 of the tile spacer 32. The seventh member 56 is between the fifth member 50 and the sixth member 52 and is angularly spaced-apart 90 degrees from each of these members. In this example, the fifth member, the sixth member, and the seventh member all extend to distal ends that define a second plane parallel to the body 37. The member 56 in this example is also between the second member 44 and the third member 46 and is similar to the first member 42 with the exception that the seventh member 56 has a length 58 which is equal to or longer than that of the first member 42 and the other members. The length 58 may be up to 1.6 times longer than member 42. In this example, the member 42 is 1.4 times the length of number 42. The seventh member 56 extends away from the body 37 radially and at an angle $\beta$. The angle $\beta$ may vary provided the seventh member 56 extends toward the second side 36. The angle $\beta$ may be in the range of between 25 and 60 degrees, and in this example, is approximately 32.5 degrees.

The use of the tile spacer 32 in combination with various arrangements of tiles will now be described. Referring to FIGS. 3 and 4, these illustrate the tile spacer 32 having members 42, 44, 46 and 48 interposed between four tiles to form a cross-shaped pattern 62 for grout. There is a first tile 63, a second tile 64, a third tile 66 and a fourth tile 67, all of which have a thickness 70 and which abut a substrate 71. The tile spacer 32 is positioned such that the first member 42 is interposed between and abuts both the fourth tile 67 and the first tile 63. The second member 44 is interposed between and abuts both the first tile 63 and the second tile 64. The third member 46 is interposed between and abuts both the second tile 64 and the third tile 66. The fourth member 48 is interposed between and abuts both the third tile 66 and the fourth tile 67. As a result, the tile spacer 32 is shaped to provide the cross-shaped grout pattern 62 with evenly spaced-apart gaps 72, 74, 76, and 78, which in this example are all equal. Referring to FIG. 4, the body 37 remains elevated by the ridges as exampled by ridge 69 of the first member 42 and is spaced-apart from the tiles between the ridges. The fifth member 50, sixth member 52 and the seventh member 56 extend away from the tiles and thereby allow a user to easily grip these members to remove the tile spacer 32 after grouting is complete.

Figure 5:
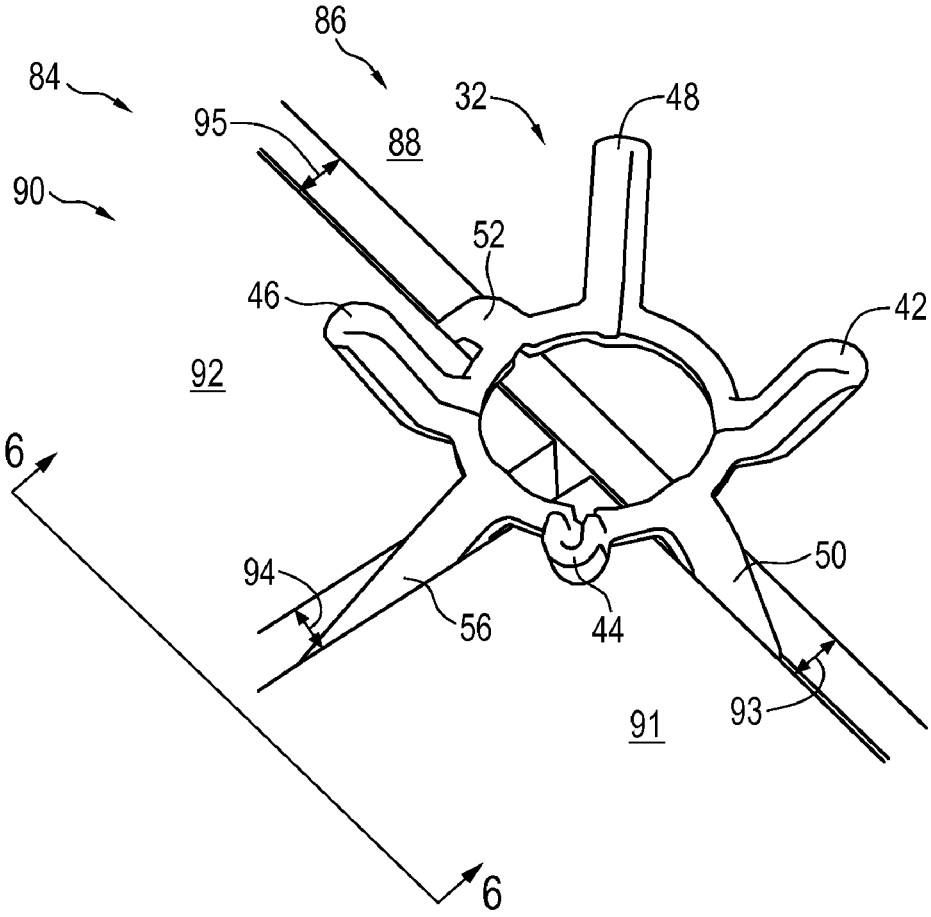
FIG. 5 is an isometric view of the tile spacer of FIG. 2 interposed between tiles arranged in a three tile T-shape pattern.
Figure 6:
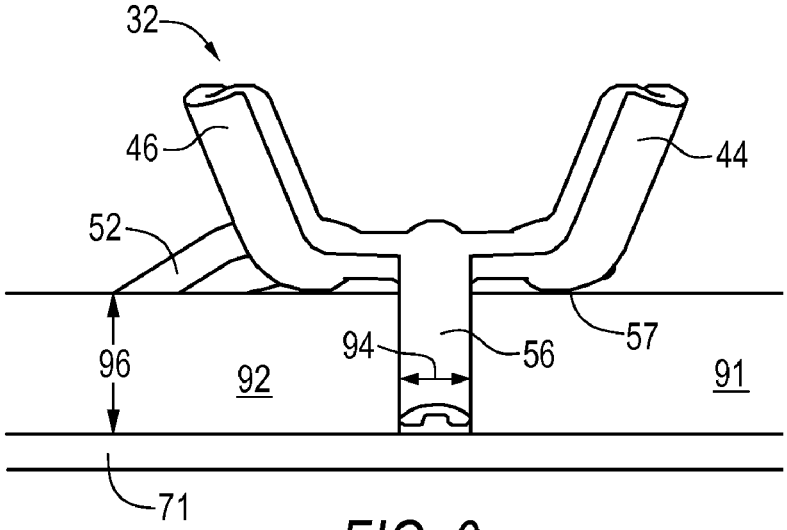
FIG. 6 is a sectional elevation view along lines 5-5 of FIG. 5.

Referring now to FIGS. 5 and 6, these illustrate the tile spacer 32 having its members 50, 52 and 56 between three tiles to form a T-shape grout pattern 84. This includes a first tile 88, a second tile 91 and a third tile 92, each of which has a tile thickness 96. The tile spacer 32 is positioned such that the fifth member 50 is interposed between and abuts both the first tile 88 and the second tile 91. The seventh member 56 is interposed between and abuts both the second tile 91 and the third tile 92. The sixth member 52 is interposed between and abuts both the third tile 92 and the first tile 88. The tile spacer 32 thereby enables the three tiles requiring a T-shape grout pattern 84 to be evenly-spaced apart through gaps 93, 94, and 95, which in this example are equal in width. The first member 42, the second member 44, the third member 46 and the fourth member 48 extend away from the tiles and thereby allow a user to easily grip these members to remove the tile spacer 32 after grouting is complete.

Figure 7:
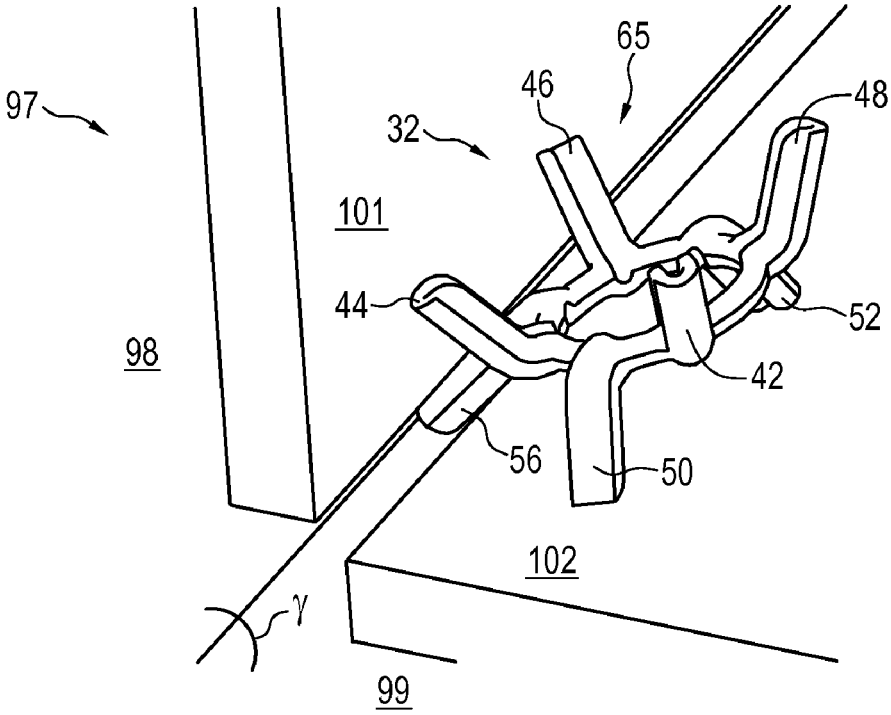
FIG. 7 is an isometric view of the tile spacer of FIG. 2 interposed between two tiles at a two-sided corner.
Figure 8:
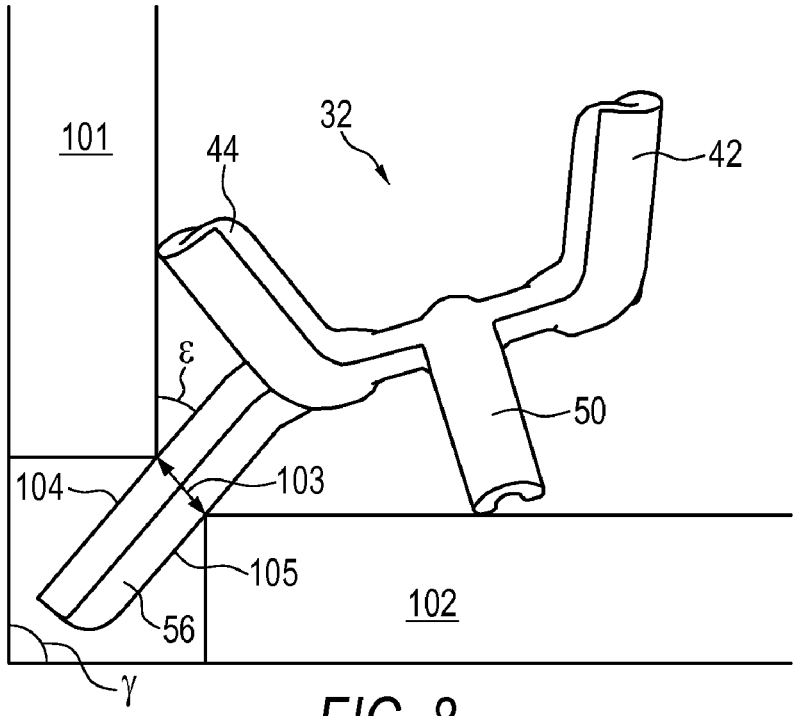
FIG. 8 is a front elevation view of FIG. 7.

Referring now to FIGS. 7 and 8, the tile spacer 32 is shown as used to space tiles that meet at a two-sided corner 97 at an angle γ. This includes a first tile 101 abutting a first wall 98, and a second tile 102 abutting a second wall 99. In this example the angle γ is 90 degrees. The tile spacer 32 is positioned such that the seventh member 56 is interposed between the first tile 101 and the second tile 102. The second member 44 and the third member 46 abut the first tile 101. The fifth member 50 and the sixth member 52 abut the second tile 102. The tile spacer 32 thereby provides for evenly spaced-apart tiles that meet at a two-sided corner 97 with an even grouting gap 103.

The tile spacer 32 has members 44 and 46 on tile 101 and members 50 and 52 on tile 102 and thereby positions the seventh member 56 at an exact 45 degree angle ϵ with respect to the tiles 101 and 102. When the second member 44, the third member 46 and the seventh member 56 are all contacting the first tile 101 and when the fifth member 50, the sixth member 52 and the seventh member 56 are all contacting the second tile 102, the desired gap 103 between the first tile 101 and the second tile 102 is thereby achieved.

The first member 42 and the fourth member 48 extend away from the second tile 102, and thereby allow a user to easily grip these members to remove the tile spacer 32 after grouting is complete.

Figure 9:
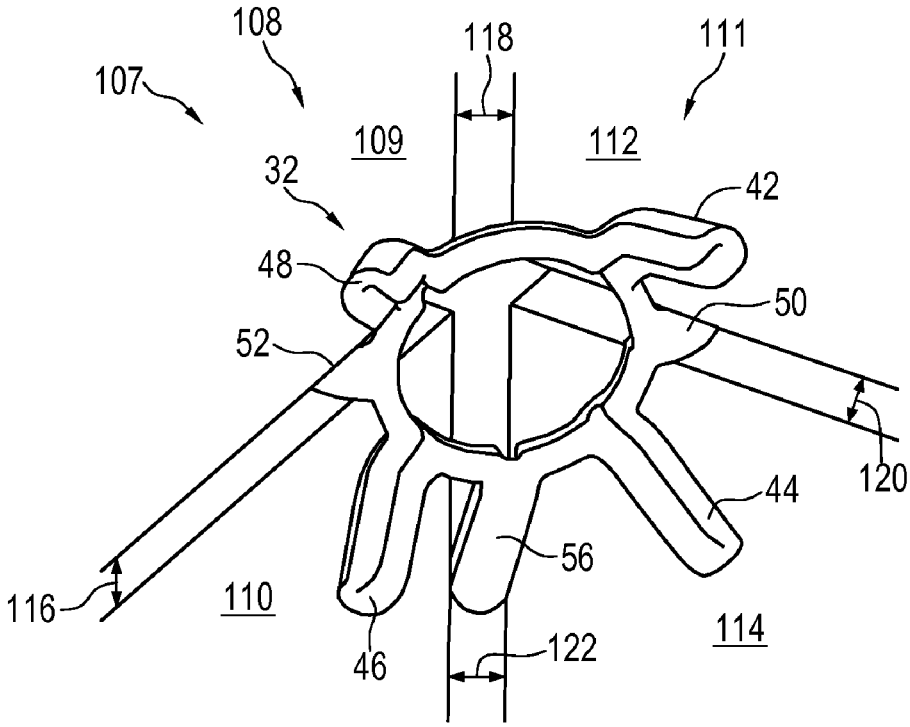
FIG. 9 is an isometric view of the tile spacer of FIG. 2 interposed between tiles in two rows that abut a two-sided corner.
Figure 10:
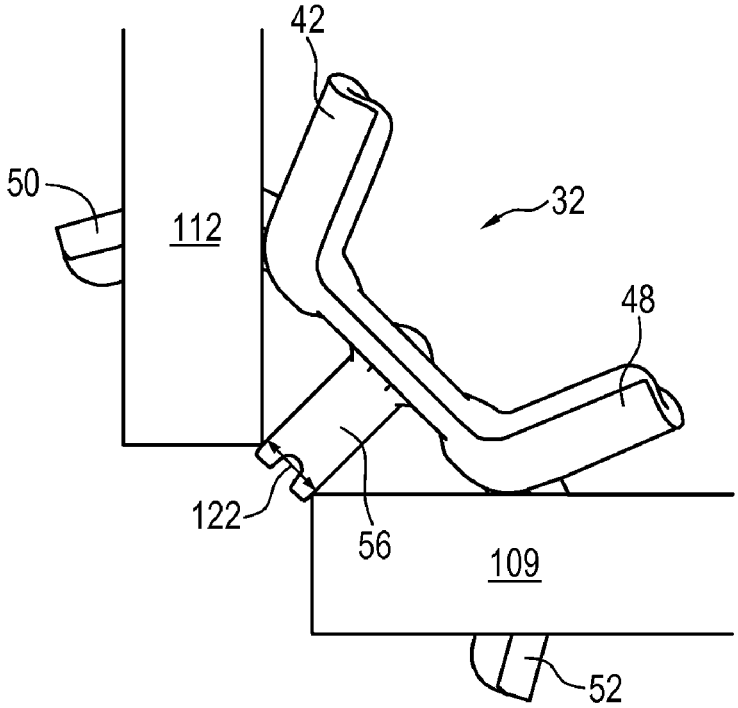
FIG. 10 is a top plan view of FIG. 9.

Referring now to FIGS. 9 and 10, the tile spacer 32 is shown between tiles in two rows of tiles that abut a two-sided corner 107, including a first column 108 having a first tile 109 and a second tile 110, and a second column 111 having a third tile 112 and a fourth tile 114. In this example, the second tile 110 and the fourth tile 114 are previously positioned as shown. The tile spacer 32 is then positioned such that the sixth member 52 is between and abuts both the first tile 109 and the second tile 110. The fifth member 50 is positioned between and abuts the third tile 112 and the fourth tile 114. The seventh member 56 is placed between and abuts the second tile 110 and the fourth tile 114. As a result, the tile spacer 32 enables even spacing between the tiles in two rows that abut a two-sided corner 107, forming gaps 116, 120 and 122, which in this example are all of equal width. The first member 42, the second member 44, the third member 46 and the fourth member 48 extend outwards away from the tiles and thereby allow a user to easily grip these members to remove the tile spacer 32 after grouting is complete.

Installation of tiles as illustrated in FIGS. 9 and 10 has significant advantages in setting grout gaps at corners. It is preferable that the horizontal lines formed by any chosen pattern type extend from wall to wall or surface to surface. In most cases, such as shower stalls tiled on three sides or counter tops tiled to back splash tiles, the two or three tiled surfaces will be close to 90 degrees to one another. The tile spacer 32 when installed in such a manner as illustrated in FIGS. 9 and 10 will force alignment of horizontal grout gaps, such as gaps 116 and 120.

Figure 11:
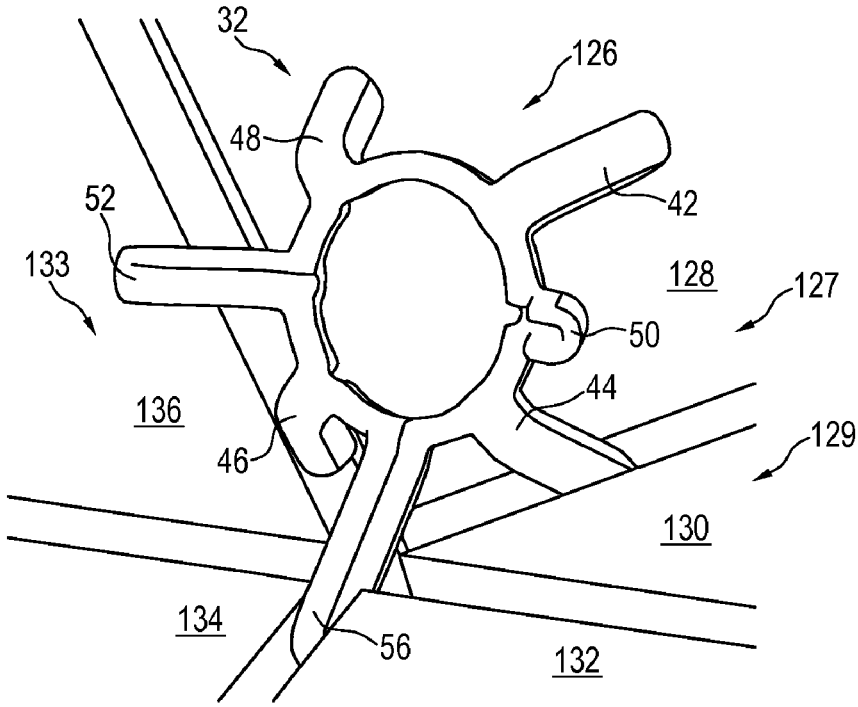
FIG. 11 is an isometric view of the tile spacer of FIG. 2 interposed between tiles arranged in a Y-shape pattern.
Figure 12:
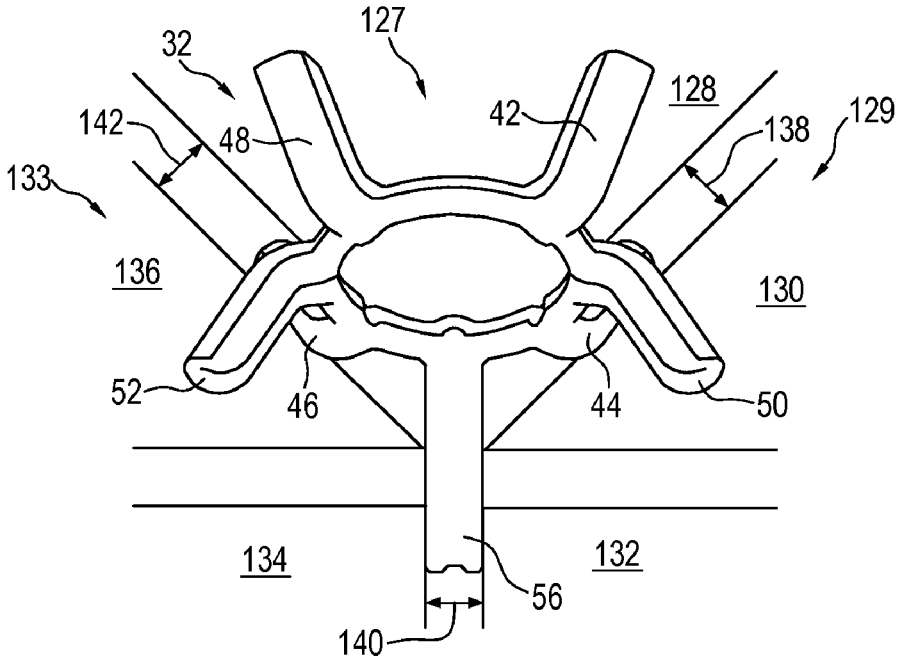
FIG. 12 is a top plan view of FIG. 11.

Referring now to FIGS. 11 and 12, the tile spacer 32 is used to position tiles with a Y-shape grout pattern 126. In this example, there is a first set of tiles 127 including a first tile 128. A second set of tiles 129 includes a second tile 130 and a third tile 132. A third set of tiles 133 has a fourth tile 134 and a fifth tile 136. The tile spacer 32 is positioned such that the second member 44 is interposed between and abuts both the first tile 128 and the second tile 130. The seventh member 56 is interposed between and abuts both the third tile 132 and the fourth tile 134. The seventh member 56 may also abut both the second tile 130 and the fifth tile 136. The third member 46 is interposed between and abuts both the fifth tile 136 and the first tile 128. Accordingly, the tile spacer 32 enables even spacing between tiles requiring a Y-shape grout pattern through gaps 138, 140, and 142, which in this example are all of equal width. The first member 42, the fourth member 48, the fifth member 50 and the sixth member 52 are all spaced-apart from the tiles and therefore allow a user to easily grip these members to remove the tile spacer 32 after grouting is complete.

Figure 13:
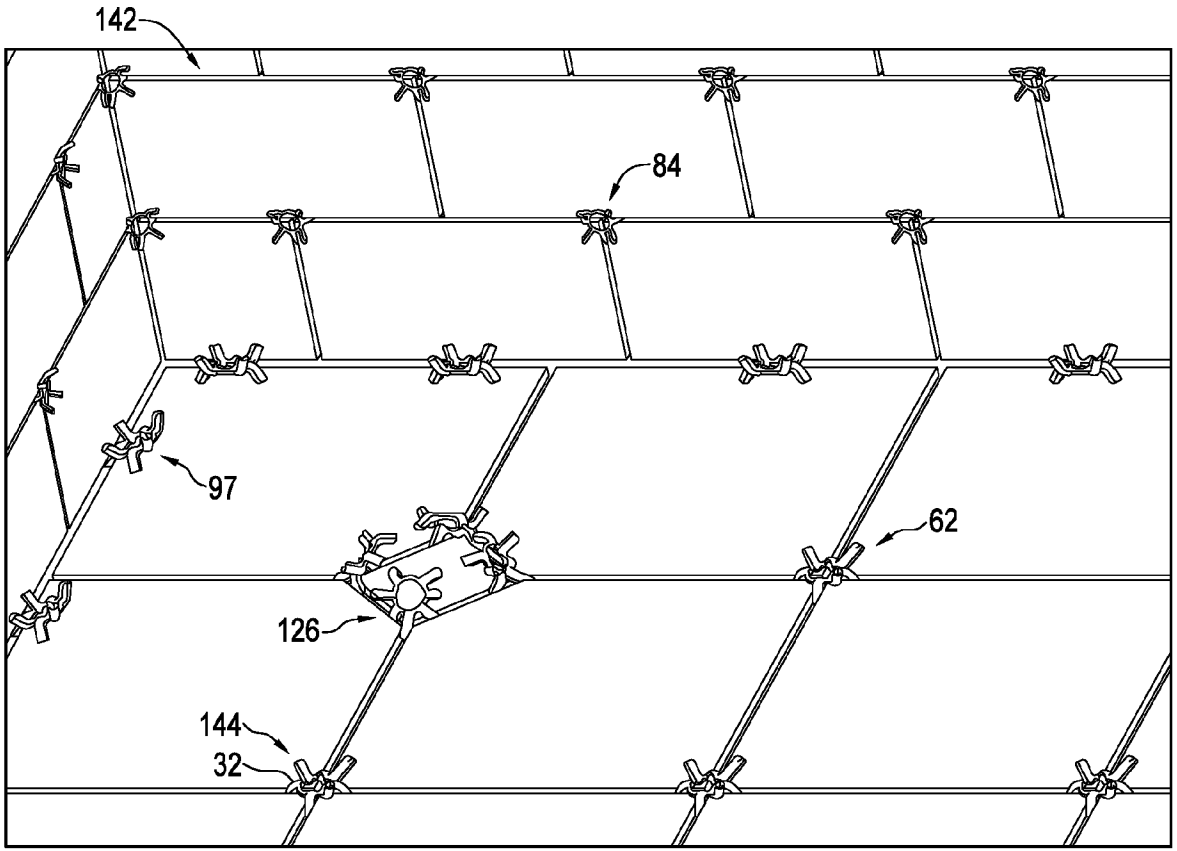
FIG. 13 is an isometric view of a plurality of the tiles spacers of FIG. 2 interposed between a plurality of tiles.

An illustration of many of the above tile arrangements in combination with a plurality of tile spacers 32 is depicted in FIG. 13, which shows a plurality of tiles 142 that are evenly spaced-apart by the plurality of tile spacers 144 as exampled by tile spacer 32. Tiles of various arrangement patterns include four tiles requiring a cross-shape grout pattern 62, three tiles requiring a T-shape grout pattern 84, two tiles at a two-sided corner 97, and tiles requiring a Y-shape grout pattern 126.

Figure 14:
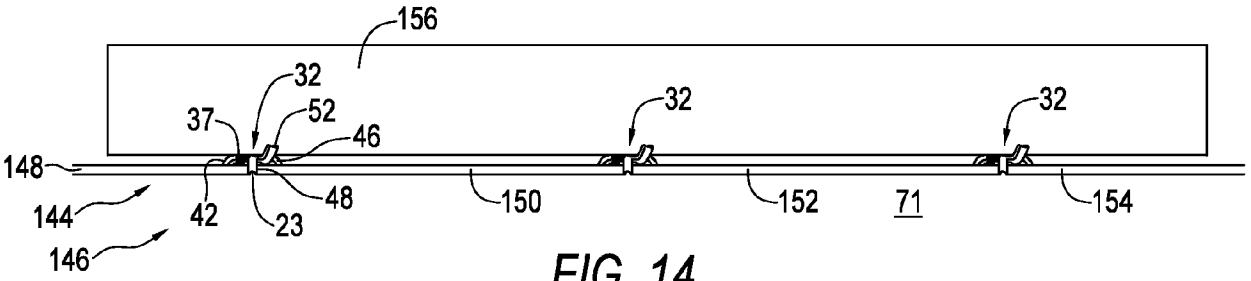
FIG. 14 is a front elevation view of three of the tile spacers of FIG. 2 supporting an elongated ruler.

Referring now to FIG. 14, a straight edge such as a ruler 156 is shown placed upon a plurality of the tile spacers 144 interposed between tiles 148, 150, 152, and 154. In this example, for each tile spacer 32 the ruler 156 abuts the body 37 and is interposed between the sixth member 52 and the seventh member 56 (shown in FIG. 2). The tile spacers thereby support the ruler 156 which is then used to gauge whether the tiles 148, 150, 152 and 154 are on an even plane. Put another away, the ruler 156 is placed across the tops of annular bodies 37 which thereby provide the user with a parallel reference surface line or edge.

This methodology helps the user to quickly spot unevenness from tile to tile or in an overall area. Where a substrate 71 is uneven, the tile spacers aid in identifying a non-parallel sight line that is appropriate in that area and help the user to vary the tile setting height. This will thereby result in a smoothing out of substrate anomalies to convey the overall impression of flatness in the finished surface. The user may decide on two tiles spacers that are determined to be at the correct level and use these to span anomalous substrate areas with the straight edge and quickly spot unevenness from tile to tile or in an overall area.

Figure 15:
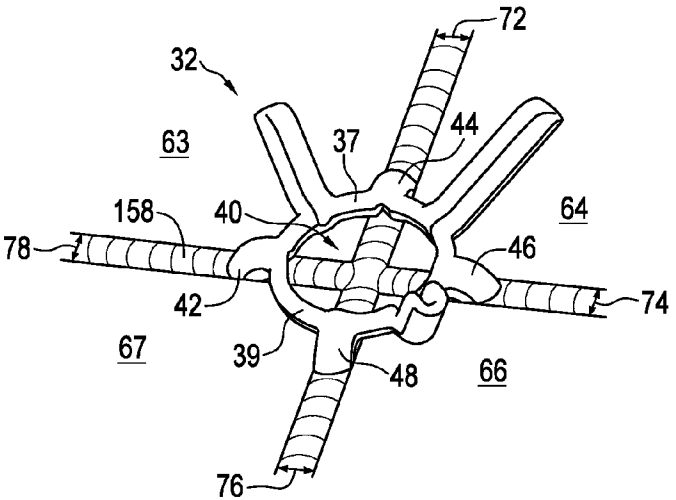
FIG. 15 is an isometric view similar to FIG. 3 with grouting applied between the tiles.

The application of adhesive 158 to tiles which are spaced-apart by a spacer 32 is shown in FIG. 15. When tiles slide in place there is an adhesive buildup in gaps 72, 74, 76, and 78. Because of the open nature of the tile spacer 32, which includes annular body 37, the tile spacer 32 of the present invention provides the important advantage to the user of clear visibility and identification of any excess adhesive, which is aesthetically and functionally undesirable. Cleaning excess adhesive off the plurality of elongate members of the spacer is extremely easy due to the flexibility of the plurality of elongate members 38.

The elongate members have small cross-sections and this therefore minimizes contact between the adhesive 158 and tile spacer 32. As a result, cleaning excess tile adhesive from the plurality of elongate members is rendered even easier. Also, the small cross-section of the elongate members allows them to easily penetrate the adhesive 158 and contact the firm substrate wood or concrete material. There is a significant benefit to this especially if the substrate is even, true and flat. As a consequence, the annular body 37 acts as a visual cue for the user to gauge the distance from substrate surface to tile surface. Unevenness from tile to tile or in an overall area can quickly be spotted and rectified.

The body 37 remains elevated above the tiles by ridges as exampled by ridge 69 of the first member 42, as illustrated for example in FIG. 4. This provides the user further enhanced visibility of any contamination problem in advance of the adhesive setting. An additional beneficial effect of the body not contacting tops faces of tiles is that hand made, quarry stone, slate, bevel edge and subway tiles, all of which have unpredictable or angled top faces, are readily accommodated by the tile spacer 32 of the present invention.

Figure 16:
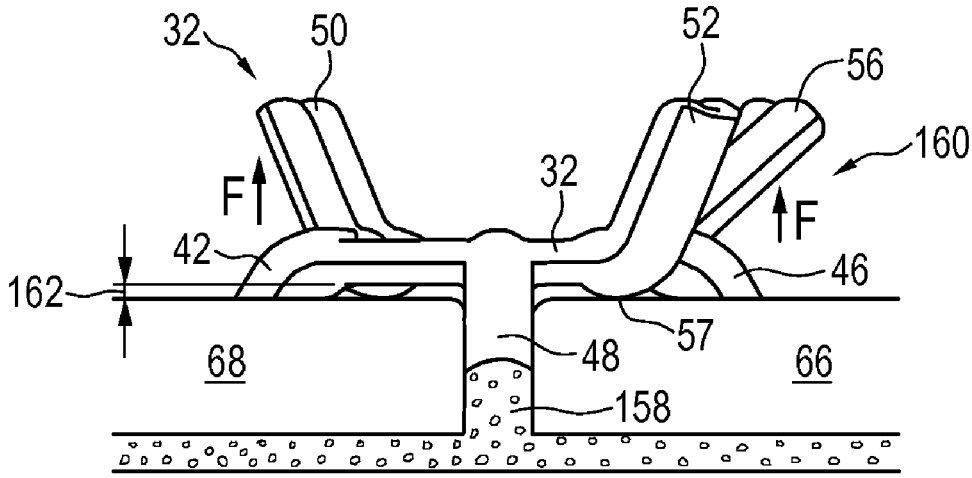
FIG. 16 is a front elevation view of FIG. 15.

Referring now to FIG. 16, when the adhesive 158 is sufficiently set, the tile spacer 32 may be readily removed. This is because the tile spacer 32 of the present invention provides the further advantage of having an overall height that extends above the tile line. In this example, the tile spacer 32 is removed by applying a force F upon the tile spacer 32 at the fifth member 50, the sixth member 52 and/or the seventh member 56.

Because of the extremely low surface contact area of the tile spacer 32 with the adhesive 158, the removal task is made extremely simple with the use of non-specialized, commonly available hand tools. A simple stiff brush, spade, trowel, foot, hand or other means will quickly and simply dislodge the tile spacer 32 through force F.

As a result of the structure of the present invention and in summary, it will be clear to those skilled the art that the present invention results a tile spacer 32 for aligning, spacing and positioning tiles in of a wide variety of tile patterns, and that moreover is reusable, easy to handle, quickly removed, and that provides visual access to the intersecting tile corners.

One skilled in the art will appreciate that many variations fall within the subject matter of the present invention. For example, the tile spacer may be made of metal. This would provide the tile spacer with the advantages of being more durable and less prone to damage. Also, the tile spacer with such a shape allows for different manufacturing methods like die casting or investment casting. If the tile spacer is made of ferromagnetic material, a strong magnet could be used to remove the spacer.

Figure 17:
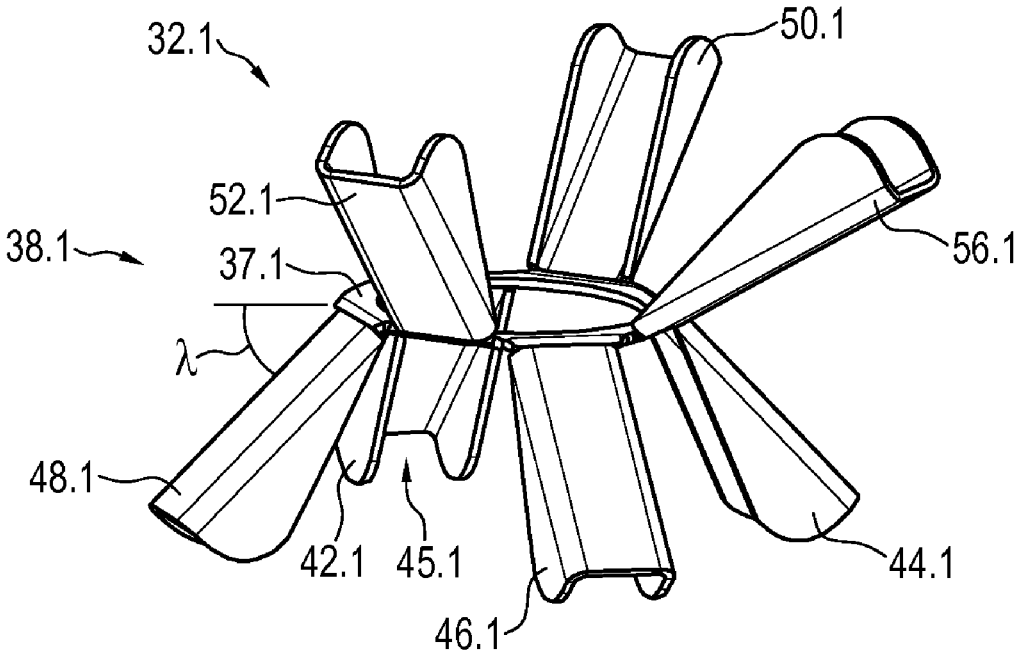
FIG. 17 is an isometric view of another embodiment of the removable tile spacer according to the present invention.

One variation is illustrated in FIG. 17, which illustrates another embodiment of the tile spacer according to the present invention. FIG. 17 is similar to FIG. 2 with like features having like numerals with the addition of "0.1". The tile spacer 32.1 in this example is made sheet metal. The tile spacer 32.1 has square groves 45.1. This allows for a simple manufacturing method while still providing necessary robustness. Sheet metal allows the user to adjust the angle $\lambda$ for each of the plurality of elongate members 38.1 as the user sees fit for a particular installation requirement.

For tile spacer interposed between two tiles at a two-sided corner as illustrated in FIGS. 7 and 8, those skilled in the art will appreciate that only the seventh member 56 and one projection portion is needed. The projection portion, for example, need only be one member from the group of the following elongate members: the second member 44, the third member 46, the fifth member 50 and the sixth member 52.

For the tiles requiring a Y-shaped grout pattern and referring to FIGS. 11 and 12, those skilled in the art will appreciate that a single, whole tile could take the place of the second tile 130 and the third tile 132, and that a single, whole tile could take the place of the fourth tile 134 and the fifth tile 136.

The tile spacer 32 used for the tiles requiring a Y-shape grout pattern, as illustrated in FIGS. 11 to 12, may similarly be used in conjunction with a hexagonal-shaped tile setting.

Those skilled in the art will appreciate that the tile spacer may be used in conjunction with tiles made from a wide spectrum of different materials, including glass, clay, natural stone, ceramic or metal.

Figure 18:
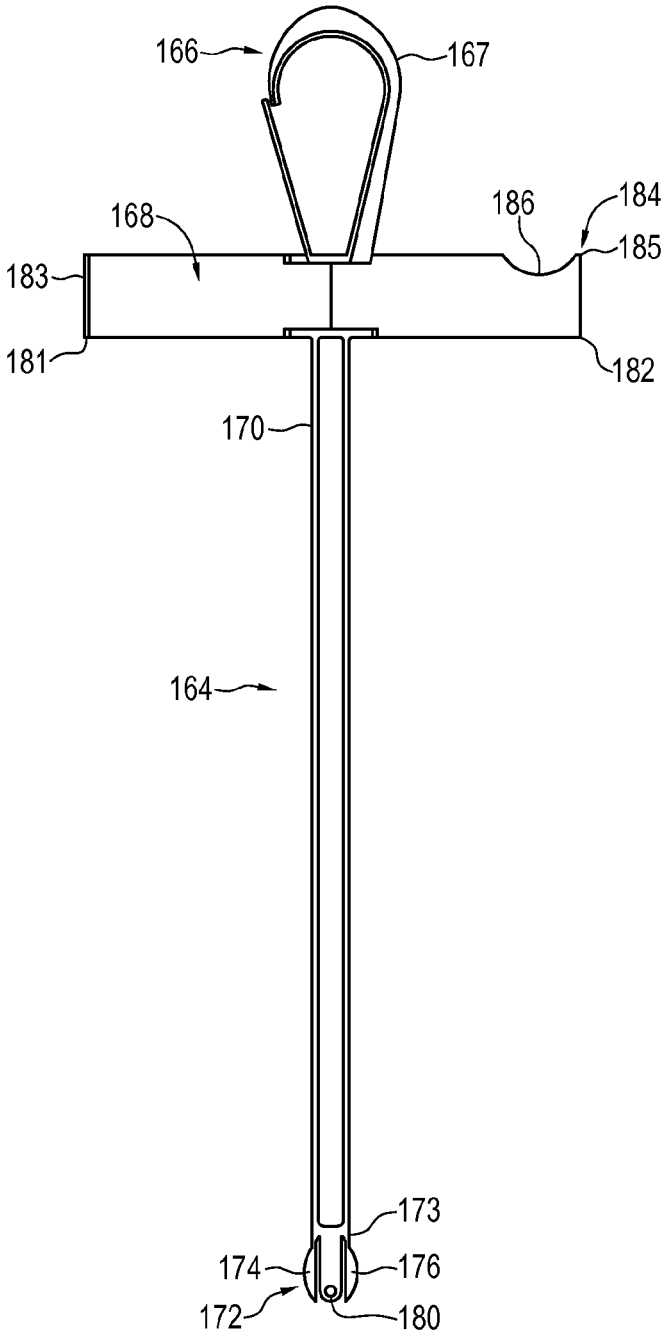
FIG. 18 is a front elevation view of the tiling tool.

A further aspect of the invention will now be described in FIGS. 18 to 21. Referring to FIG. 18, a tiling tool 164 for storing and dispensing a stack 162 of tile spacers is illustrated. The tiling tool 164 has a first end 166 with a clip 167. The clip 167 may attach to rope or a user's belt or the like. The tiling tool 164 has a handle 168 with a first end 181 and a second end 182. A squeegee 183 extends from the first end 181. An inwardly extending recess 186 is located adjacent to the second end 182. A chisel 184 is located at the second end. In a preferred embodiment, the chisel 184 is formed from a hard material to thereby provide the chisel 184 with a harder edge 185. A rod 170 extends from the handle 168.

A dispenser 172 extends from the rod 170 at a distal end 173. The dispenser 172 in this example comprises a central portion 180 interposed between resilient members 174 and 176, which are generally D-shaped members in this example. The resilient members 174 and 176 are inwardly compressible towards the central portion 180.

Figure 19:
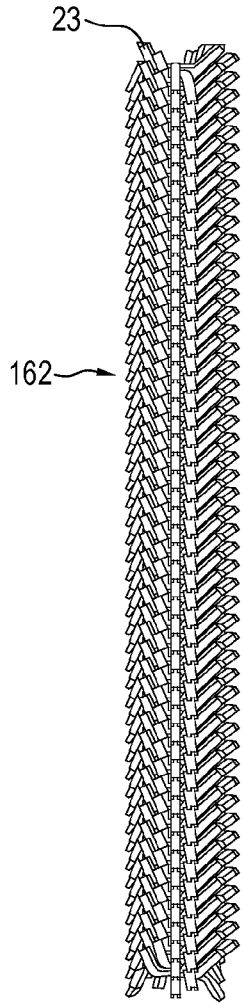
FIG. 19 is a front elevation view of a plurality of the tile spacers of FIG. 2 stacked together.

Referring now to FIG. 19, a stack of tile spacers 162 is illustrated. Each tile spacer 32 is so shaped as to allow a compact stacking of a plurality of tile spacers 162. One example of such stacking is interposing the plurality of elongate members extending to the first side from one tile spacer with the plurality of elongate members extending to the second side of another tile spacer.

Figure 20:
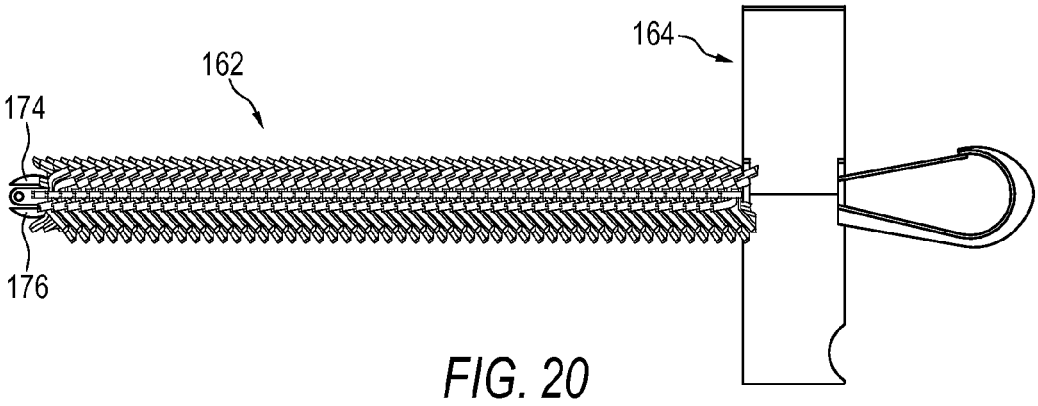
FIG. 20 is a side elevation view of a multipurpose tile spacer dispenser and tiling tool of FIG. 18 engaging the plurality of stacked tile spacers of FIG. 19.
Figure 21:
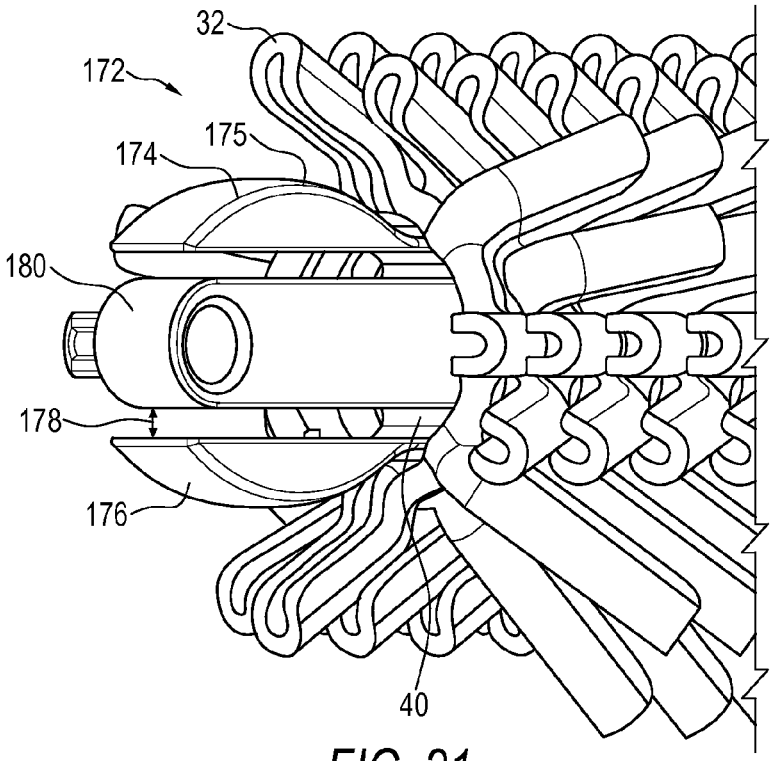
FIG. 21 is an isometric, partial view of FIG. 20 illustrating a dispenser at a distal end of the multipurpose tile spacer dispenser and tiling tool.

The rod 170 extends through apertures 40 of the tile spacers as shown in FIGS. 20 and 21. In the position shown in FIG. 20, the resilient members 174 and 176 inhibit a tile spacer from being removed from the tiling tool 164. When the resilient members 174 and 176 are compressed together, the tile spacers 32 may pass over them. In this way the user may selectively remove tile spacers as required.

This is advantageous because when tiling the user can systematically work in rows or columns away from a reference point, feature or predefined line. The dispenser 172 offers a convenient method of hands-free organization and conveyance of tile spacers when clipped to tool belt or coverall strap. In vertical tiling applications, the dispenser 172 may be attached by clip 167 to a nail or hook in a nearby location. This results in a ready supply of spacers being accessible to the user.

A further advantage of the dispenser 172 is that it enables the user to hold single items or multiple quantities using one hand. Once the adhesive is cured and the tile spacers are removed by previously discussed means, the dispenser 172 may be reloaded and reused.

The tiling tool 164 provides further advantages in the form of its variety of added features. The squeegee 183, which extends from end 181 of the handle 168, may be used to clean, spread and manipulate adhesive material. The squeegee may be used to pre-apply the adhesive to the bottom side of a tile in specific cases. The opposite end 182 of the handle 168 forms the chisel 184 which provides the benefit of being insertable into small gaps between the tiles to help manipulate or move the tiles before adhesion takes place. The recess 186 adjacent to the chisel may be used as a scooping device for cleaning excess adhesive material from the adhesive grout gaps.

Those skilled in the art will appreciate that many variations are possible for the tiling tool 164. For example, there need only be one resilient member at the distal end 173 of the dispenser 172 used in conjunction with the central portion 180. Alternatively, there may simply be two resilient members without the need of the central portion.

It will be understood by someone skilled in the art that many of the details provided above are by way of example only and are not intended to limit the scope of the invention which is to be determined with reference to the following claims.

What is claimed is:

1. A tile spacer comprising:

a first set of elongate members, each having a proximal end and a distal end, the proximal ends being connected together and the distal ends being spaced-apart for setting spacing between tiles; and a body, the body being annular, the members of the first set of elongate members connected to and radially extending away from the body at a non-perpendicular angle relative to the body, and the body having a portion which is spaced-apart above the tiles when the distal ends of the members are fitted within spaces between the tiles, thereby facilitating removal when tile spacing is completed.

2. The tile spacer as claimed in claim 1, having a first side, the first set of elongate members extending from the proximal ends thereof towards the first side.

3. The tile spacer as claimed in claim 2, having a second side which is opposite the first side, the tile spacer having a second set of elongate members, each having a proximal end and a distal end, the proximal ends of the second set of elongate members being adjacent to the proximal ends of the first set of elongate members, the second set of elongate members extending from the proximal ends thereof towards the second side of the tile spacer.

4. The tile spacer as claimed in claim 3, wherein the members of the first set of elongate members are angularly spaced-apart for spacing tiles in a first configuration of tiles and the members of the second set of elongate members are spaced-apart for spacing tiles in a second configuration of tiles.

5. The tile spacer as claimed in claim 3, wherein the members of the first set of elongate members are angularly spaced-apart 90 degrees from each other and the second set of elongate members includes two members which are angularly spaced-apart 180 degrees and a third member which is angularly spaced-apart 90 degrees from each of said two members.

6. The tile spacer as claimed in claim 3, wherein the first set of elongate members extend to the first side, the first side defining a first plane parallel with the body, and the second set of elongate members extend to the second side, the second side defining a second plane parallel to the body.

7. The tile spacer as claimed in claim 1, wherein the body connects the proximal ends of the elongate members together, the members of the first set of elongate members connected to and radially extending away from the body at an angle of between 45 to 75 degrees relative to the body.

8. The tile spacer as claimed in claim 1, where in the elongate members are channel-shaped.

9. In combination, a plurality of tiles arranged on a surface and the tile spacer as claimed in claim 1.

10. The combination as claimed in claim 9, wherein the tile spacer has a first side, the first set of elongate members extending from the proximal ends thereof towards the first side.

11. The combination as claimed in claim 10, wherein the tile spacer has a second side which is opposite the first side, the tile spacer having a second set of elongate members, each having a proximal end and a distal end, the proximal ends of the second set of elongate members being adjacent to the proximal ends of the first set of elongate members, the second set of elongate members extending from the proximal ends thereof towards the second side of the tile spacer.

12. The combination as claimed in claim 11, wherein the members of the first set of elongate members are angularly spaced-apart for spacing tiles in a first configuration of tiles and the members of the second set of elongate members are spaced-apart for spacing tiles in a second configuration of tiles.

13. The combination as claimed in claim 11, wherein the members of the first set of elongate members are angularly spaced-apart 90 degrees from each other and the second set of elongate members includes two members which are angularly spaced-apart 180 degrees and a third member which is angularly spaced-apart 90 degrees from each of said two members.

14. The combination as claimed in claim 11, wherein a connecting member connects the proximal ends of the elongate members together.

15. A removable tile spacer for enabling even spacing between a first tile arranged at a corner with a second tile, the first tile and the second tile being perpendicular to each other, the removable tile spacer comprising:

a body having a first face and a second face opposite the first face;

a first elongate member connected to the body at a proximal end and extending away from the first face to a distal end of the elongate member; and a projection portion connected to the body and extending away from one of said first face and said second face, the projection portion being shaped to position the first member at a 45 degree angle relative to the first tile and the second tile, whereby when the first member is interposed between the first tile and the second tile and the projection portion abuts one of said first tile and said second tile, the removable tile spacer thereby provides even spacing between the first tile and the second tile.

16. The tile spacer as claimed in claim 15, wherein the first member extends away from the body between 1.2 to 1.6 times further than the projection portion.

17. The tile spacer as claimed in claim 16, wherein the projection portion comprises a second elongate member and a third elongate member, the third member being spaced-apart from the second member, the first member being interposed between the second member and the third member.

18. The tile spacer as claimed in claim 15, wherein the first member extends away from the body 1.4 times further than the projection portion.

19. A removable tile spacer for evenly spacing apart tiles of various arrangement patterns including four tiles requiring a cross-shape grout pattern and three tiles requiring a T-shape grout pattern, the tile spacer comprising:

a body having a first face and a second face opposite the first face;

a first plurality of angularly, evenly spaced-apart members connected to the body and extending from the first face of the body, the first plurality of members including a first elongate member, a second elongate member, a third elongate member and a fourth elongate member, the first plurality of members being interposable between the four tiles requiring the cross-shape pattern; and a second plurality of radially spaced-apart members connected to the body and extending from the second face of the body, the second plurality of members including a fifth elongate member, a sixth elongate member being opposite from the fifth elongate member, and a seventh elongate member interposed between the fifth member and the sixth member, the second plurality of members being interposable between the three tiles requiring the T-shape tile pattern.

20. The tile spacer as claimed in claim 19, wherein the body is annular.

21. The tile spacer as claimed in claim 19, wherein the tiles of various arrangement patterns further include tiles requiring a Y-shape grout pattern, the fifth member being interposed between the first member and the second member, the sixth member interposed between the third member and the fourth member, and the seventh member interposed between the second member and the third member, whereby, the tile spacer is interposable between the tiles requiring the Y-shape grout pattern by interposing between said tiles requiring the Y-shape grout pattern one group from the groups consisting of: the second member, the third member, and the seventh member; the first member, the second member and the fifth member; and the third member, the fourth member, and the sixth member.

22. A tiling tool for a plurality of tile spacers, the plurality of tile spacers being stacked together, each said plurality of tile spacers having apertures aligned with each other, the tiling tool comprising:

a handle having a first end and a second end, a squeegee extending from the first end, and a chisel extending from the second end, the handle having an inwardly extending recess adjacent to the chisel, a clip extending from the handle; and a rod outwardly extending from the handle, the rod being shaped to fit through each of said apertures of the plurality of tile spacers, the rod having a resilient member located at a distal end of the rod, the resilient member being inwardly compressible, whereby the tiling tool has a first state where the resilient member inhibits each of said plurality of tile spacers from being removed past the distal end of the tiling tool, and the tiling tool has second state where when the resilient member is inwardly compressed, each of said plurality of tile spacers is removable past the distal end of the tiling tool.

23. A tile spacer having a first side and a second side which is opposite the first side and comprising:

a first set of elongate members, each having a proximal end and a distal end, the proximal ends being connected together and the distal ends being spaced-apart for setting spacing between tiles, the first set of elongate members extending from the proximal ends thereof towards the first side of the tile spacer, the members of the first set of elongate members being angularly spaced-apart 90 degrees from each other;

a second set of elongate members, each having a proximal end and a distal end, the proximal ends of the second set of elongate members being adjacent to the proximal ends of the first set of elongate members, the second set of elongate members extending from the proximal ends thereof towards the second side of the tile spacer, the second set of elongate members including two members which are angularly spaced-apart 180 degrees and a third member which is angularly spaced-apart 90 degrees from each of said two members, the third member being longer than the two members; and a body, the first set of elongate members and the second set of elongate members connecting to the body, the body having a portion which is spaced-apart above the tiles when the distal ends of the first set of elongate members are fitted within spaces between the tiles, thereby facilitating removal when tile spacing is completed, the third member of the second set of elongate members extending outwardly at an angle of 135 degrees relative to the body.

24. The tile spacer as claimed in claim 23, wherein the body is annular.

25. In combination, a plurality of tiles arranged on a surface and a tile spacer as claimed in claim 23.

26. In combination, a plurality of tiles arranged on the surface with spaces in between and a tile spacer, the tile spacer having a first side and a second side which is opposite the first side, the tile spacer comprising:

a first set of elongate members, each being channel-shaped and having a proximal end and a distal end, the proximal ends being connected together and the distal ends being spaced-apart for setting the spaces between the tiles, the first set of elongate members extending from the proximal ends thereof towards the first side;

a second set of elongate members, each being channel-shaped and having a proximal end and a distal end, the proximal ends of the second set of elongate members being adjacent to the proximal ends of the first set of elongate members, the second set of elongate members extending from the proximal ends thereof towards the second side of the tile spacer;

a body, the first set of elongate members and the second set of elongate members connecting to the body, the body having a portion which is spaced-apart above the tiles when the distal ends of the members of the first set of elongate members are fitted within the spaces between the tiles, thereby facilitating removal when tile spacing is completed; and a connecting member which connects the proximal ends of the members of the first set of elongate members and the members of the second set of elongate members together, the connecting member being annular.

27. A tile spacer having a first side and a second side which is opposite the first side, the tile spacer comprising:

a first set of elongate members, each being channel-shaped and having a proximal end and a distal end, the proximal ends being connected together and the distal ends being spaced-apart for setting spacing between tiles, the first set of elongate members extending from the proximal ends thereof to the first side;

a second set of elongate members, each being channel-shaped and having a proximal end and a distal end, the proximal ends of the second set of elongate members being adjacent to the proximal ends of the first set of elongate members, the second set of elongate members extending from the proximal ends thereof to the second side of the tile spacer; and a body being annular and connecting the proximal ends of the elongate members together, the body having a portion which is spaced-apart above the tiles when the distal ends of the members of the first set of elongate members are fitted within spaces between the tiles, thereby facilitating removal when tile spacing is completed, the first side defining a first plane parallel with the body, the second side defining a second plane parallel to the body.

28. A tile spacer having a first side and a second side which is opposite the first side, the tile spacer comprising:

a first set of elongate members, each having a proximal end and a distal end, the proximal ends being connected together and the distal ends being spaced-apart for setting the spaces between tiles, the first set of elongate members extending from the proximal ends thereof towards the first side;

a second set of elongate members, each having a proximal end and a distal end, the proximal ends of the second set of elongate members being adjacent to the proximal ends of the first set of elongate members, the second set of elongate members extending from the proximal ends thereof towards the second side of the tile spacer;

a body, the first set of elongate members and the second set of elongate members connecting to the body, the body having a portion which is spaced-apart above the tiles when the distal ends of the members are fitted within the spaces between the tiles, thereby facilitating removal when tile spacing is completed; and a connecting member which connects the proximal ends of the elongate members together, each of the elongate members extending outwardly from the connecting member at an angle of 120 degrees relative to the connecting member.

29. In combination, a plurality of tiles arranged on a surface and a tile spacer as claimed in claim 28.

30. A tile spacer for use with a plurality of tiles that abut a two-sided corner, said plurality of tiles including a first column having a first tile and a second tile, and a second column having a third tile and a fourth tile, the first column and the second column being perpendicular to each other, the tile spacer having a first side and comprising:

a body having a first face positioned adjacent to said plurality of tiles, the body being annular;

a first elongate member connected to the body and extending toward the first side, the first member being interposed between and abutting both the first tile and the second tile;

a second elongate member connected to the body and extending toward the first side, the second member being spaced-apart from the first member, the second member being interposed between and abutting both the third tile and the fourth tile, the first member and the second member being shaped such that the first face of the body is spaced-apart from said plurality of tiles; and a third elongate member connected to the body and extending toward the first side, the third member being interposed between the first member and the second member, the third member being interposed between and abutting one from the group consisting of—the second tile and the fourth tile—and—the first tile and the third tile.

* * * * *